US009970088B2

(12) United States Patent
Bocharova et al.

(10) Patent No.: US 9,970,088 B2
(45) Date of Patent: May 15, 2018

(54) MULTI-PHASE STEEL, COLD-ROLLED FLAT PRODUCT PRODUCED FROM SUCH A MULTI-PHASE STEEL AND METHOD FOR PRODUCING IT

(75) Inventors: Ekaterina Bocharova, Duisburg (DE); Dorothea Mattissen, Mulheim an der Ruhr (DE); Roland Sebald, Geldern (DE); Daniel Krizan, Linz (AT); Andreas Pichler, Voecklabruck (AT)

(73) Assignee: ThyssenKrupp Steel Europe AG, Duisburg (DE)

( * ) Notice: Subject to any disclaimer, the term of this patent is extended or adjusted under 35 U.S.C. 154(b) by 669 days.

(21) Appl. No.: 13/877,782

(22) PCT Filed: Sep. 22, 2011

(86) PCT No.: PCT/EP2011/066522

§ 371 (c)(1),
(2), (4) Date: Jun. 11, 2013

(87) PCT Pub. No.: WO2012/045595

PCT Pub. Date: Apr. 12, 2012

(65) Prior Publication Data

US 2013/0284321 A1 Oct. 31, 2013

(30) Foreign Application Priority Data

Oct. 5, 2010 (EP) ..... 10186553

(51) Int. Cl.

| | |
|---|---|
| ***C22C 38/06*** | (2006.01) |
| ***C22C 38/14*** | (2006.01) |
| ***C21D 6/00*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/12*** | (2006.01) |

(52) U.S. Cl.

CPC ..... *C22C 38/14* (2013.01); *C21D 6/005* (2013.01); *C21D 8/0205* (2013.01); *C21D 8/0263* (2013.01); *C21D 9/46* (2013.01); *C22C 38/001* (2013.01); *C22C 38/02* (2013.01); *C22C 38/04* (2013.01); *C22C 38/06* (2013.01); *C22C 38/12* (2013.01); *C21D 2211/001* (2013.01); *C21D 2211/002* (2013.01); *C21D 2211/005* (2013.01); *C21D 2211/008* (2013.01)

(58) Field of Classification Search

CPC ..... C22C 38/00; C22C 38/001; C22C 38/002; C22C 38/004; C22C 38/005; C22C 38/008; C22C 38/02; C22C 38/04; C22C 38/06; C22C 38/08; C22C 38/12; C22C 38/14; C22C 38/16; C22C 38/18; C22C 38/20; C22C 38/22; C22C 38/24; C22C 38/26; C22C 38/28; C22C 38/30; C22C 38/32; C22C 38/34; C22C 38/38; C22C 38/40; C22C 38/42; C22C 38/44; C22C 38/46; C22C 38/48; C22C 38/50; C22C 38/52; C22C 38/54; C22C 38/56; C22C 38/58; C22C 38/60

See application file for complete search history.

(56) References Cited

U.S. PATENT DOCUMENTS

| | | | | |
|---|---|---|---|---|
| 6,395,108 | B2 * | 5/2002 | Eberle | C21D 1/185 148/330 |
| 2006/0140814 | A1 | 6/2006 | Antonissen et al. | |
| 2008/0295928 | A1 * | 12/2008 | Kim | C21D 8/0236 148/651 |
| 2009/0053096 | A1 | 2/2009 | Miura et al. | |

FOREIGN PATENT DOCUMENTS

| | | | |
|---|---|---|---|
| CN | 101528968 | A | 9/2009 |
| CN | 101613827 | A | 12/2009 |
| CN | 101805871 | A | 8/2010 |
| EP | 1367143 | A1 | 12/2003 |
| EP | 1431406 | A1 | 6/2004 |
| EP | 1589126 | A1 | 10/2005 |

(Continued)

OTHER PUBLICATIONS

Bleck et al., Control of Microstructure in TRIP Steels by Niobium, Materials Science Forum, 2003, pp. 43-48, vols. 426-432.

Bleck et al., Niobium in Dual Phase and TRIP Steels, Niobium Science & Technology, 2001, 26 pages.

Hanzaki et al., Hot Deformation Characteristics of Si—Mn TRIP Steels with and without Nb Microalloy Additions, ISIJ International, 1995, pp. 324-331, vol. 35, No. 3.

Tang et al., Effect of Baking Process on Microstructures and Mechanical Properties of Low Silicon TRIP Steel Sheet With Niobium, Journal of Iron and Steel Research International, 2010, pp. 68-74, vol. 17, No. 7.

Zhang et al., Continuous cooling transformation diagrams and properties of micro-alloyed TRIP steels, Materials Science and Engineering A, 2006, pp. 296-299, vol. 438-440.

*Primary Examiner* — Jessee R Roe
*Assistant Examiner* — Jophy S. Koshy
(74) *Attorney, Agent, or Firm* — The Webb Law Firm

(57) ABSTRACT

A multi-phase steel including in % wt. C: 0.14-0.25%, Mn: 1.7-2.5%, Si: 0.2-0.7%, Al: 0.5-1.5%, Cr: <0.1%, Mo: <0.05%, Nb: 0.02-0.06%, S: up to 0.01%, P: up to 0.02%, N: up to 0.01% and optionally at least one of Ti, B, and V according to the following stipulation: Ti: up to 0.1%, B: up to 0.002%, V: up to 0.15%, with the remainder iron and unavoidable impurities, wherein the microstructure has at least 10% vol. ferrite and at least 6% vol. residual austenite and the steel has a tensile strength $R_m$ of at least 950 MPa, a yield point $R_{eL}$ of at least 500 MPa and an elongation at break $A_{80}$ measured in the transverse direction of at least 15%. A method of producing the multi-phase steel.

14 Claims, No Drawings

(56) References Cited

FOREIGN PATENT DOCUMENTS

| | | | |
|---|---|---|---|
| EP | 1865085 | A1 | 12/2007 |
| JP | 1272720 | A | 10/1989 |
| JP | 2001355044 | A | 12/2001 |
| JP | 2004292869 | A | 10/2004 |
| JP | 2005325393 | A | 11/2005 |
| JP | 20062186 | A | 1/2006 |
| JP | 2006307326 | A | 11/2006 |
| JP | 2006307327 | A | 11/2006 |
| JP | 2008240116 | A | 10/2008 |
| JP | 2009521603 | A | 6/2009 |
| KR | 1020070107179 | A | 11/2007 |
| KR | 20100025928 | A | 3/2010 |
| WO | 2007075008 | A1 | 7/2007 |

* cited by examiner

MULTI-PHASE STEEL, COLD-ROLLED FLAT PRODUCT PRODUCED FROM SUCH A MULTI-PHASE STEEL AND METHOD FOR PRODUCING IT

BACKGROUND OF THE INVENTION

Field of the Invention

The invention relates to a multi-phase steel, to a cold-rolled flat product produced from such a multi-phase steel by cold rolling and to a method for producing it. The "flat products" according to the invention can be sheets, strips, blanks obtained from them or comparable products. When "cold flat products" are mentioned here, what is meant are flat products produced by cold rolling.

Description of Related Art

There is a requirement for materials, particularly in vehicle body construction, which, on the one hand, have high strengths and, on the other hand, are also deformable to such an extent that intricately shaped components can be formed from them by simple means.

A multi-phase steel, which should have a profile of properties which is balanced in this respect, is known from EP 1 367 143 A1. In addition to a comparatively high strength and good deformability, the known steel should also have particularly good weldability.

The known steel contains 0.03-0.25% wt. C for this purpose, through the presence of which, in combination with other alloying elements, tensile strengths of at least 700 MPa are to be reached. In addition, the strength of the known steel is to be supported by Mn in contents of 1.4-3.5% wt. Al is used as an oxidising agent when smelting the known steel and can be present in the steel in contents of up to 0.1% wt. The known steel can also have up to 0.7% wt, Si, the presence of which enables the ferritic-martensitic structure of the steel to be stabilised. Cr is added to the known steel in contents of 0.05-1% wt., in order to reduce the effect of the heat introduced in the area of the weld seam by the welding process. For the same purpose, 0.005-0.1% wt. Nb are present in the known steel. Nb is additionally to have a positive effect on the deformability of the steel, since its presence brings with it a refinement of the ferrite grain. For the same purpose, 0.05-1% wt. Mo, 0.02-0.5% wt. V, 0.005-0-05% wt. Ti and 0.0002-0.002% wt. B can be added to the known steel. Mo and V contribute to the hardenability of the known steel, whilst Ti and B are additionally to have a positive effect on the strength of the steel.

Another steel sheet, which consists of a high-strength multi-phase steel and can be deformed well, is known from EP 1 589 126 B1. This known steel sheet contains 0.10-0.28% wt. C, 1.0-2.0% wt. Si, 1.0-3.0% wt. Mn, 0.03-0.10% wt. Nb, up to 0.5% wt. Al, up to 0.15% wt. P and up to 0.02% wt. S. Optionally, up to 1.0% wt. Mo, up to 0.5% wt. Ni, up to 0.5% wt. Cu, up to 0.003% wt. Ca, up to 0.003% wt. rare earth metals, up to 0.1% wt. Ti or up to 0.1% wt. V can be present in the steel sheet. The microstructure of the known steel sheet in relation to its overall structure has a residual austenite content of 5-20% and at least 50% bainitic ferrite.

At the same time, the proportion of polygonal ferrite in the microstructure of the known steel sheet is to be at most 30%. By limiting the proportion of polygonal ferrite, bainite is to form the matrix phase in the known steel sheet and residual austenite portions are to be present which contribute to the balance of tensile strength and deformability. The presence of Nb is also to ensure that the residual austenite portion of the microstructure is fine-grained.

In order to guarantee this effect, in the course of producing the steel sheet known from EP 1 589 126 B1 a particularly high initial temperature for hot rolling of 1250-1350° C. is chosen. In this temperature range, Nb goes fully into solid solution, so that when hot rolling the steel a large number of fine Nb carbides form, which are present in the polygonal ferrite or in the bainite. EP 1 589 126 B1 goes on to say that although the high initial temperature for the hot rolling is the prerequisite for the fineness of the residual austenite, it does not on its own have the desired effect. Rather, for this purpose, final annealing at temperatures above the $A_{C3}$ temperature, subsequent controlled cooling at a cooling rate of at least 10° C./s to a temperature in the range from 300-450° C., at which the bainite transformation takes place, and finally maintaining this temperature over a sufficiently long period of time are also required.

SUMMARY OF THE INVENTION

Against the background of the previously described prior art, the object of the invention was to create a multi-phase steel with a further increased strength, which, at the same time, has a high elongation at break. A flat product having a further optimised combination of high strength and good deformability and a method for producing such a flat product should also be specified.

DETAILED DESCRIPTION OF THE INVENTION

A multi-phase steel according to the invention contains (in % wt.) C: 0.14-0.25%, Mn: 1.7-2.5%, Si: 0.2-0.7%, Al: 0.5-1.5%, Cr: <0.1%, Mo: <0.05%, Nb: 0.02-0.06%, S: up to 0.01%, in particular up to 0.005%, P: up to 0.02%, N: up to 0.01% and optionally at least one element from the group "Ti, B, V", and as the remainder iron and unavoidable impurities, wherein for the contents of the optionally provided elements provision is made for Ti: ≤0.1%, B: ≤0.002%, V: ≤0.15%, and wherein in the microstructure of the steel at least 10% vol. ferrite and at least 6% vol. residual austenite are present.

A steel composed and constituted according to the invention achieves a tensile strength $R_m$ of at least 950 MPa, a yield point $R_{eL}$ of at least 500 MPa and an elongation at break $A_{80}$ in the transverse direction of at least 15%.

Carbon increases the amount and the stability of the residual austenite. In steel according to the invention, therefore, at least 0.14% wt. carbon is present, in order to stabilise the austenite to room temperature and prevent a complete transformation of the austenite formed during an annealing treatment into martensite, ferrite or bainite or bainitic ferrite. Over 0.25% wt. carbon contents, however, have a negative effect on the weldability.

Mn like C contributes to the strength and to increasing the amount and the stability of the residual austenite. However, Mn contents which are too high increase the risk of liquation development. Furthermore, they have a negative effect on the elongation at break, since the ferrite and bainite transformations are greatly retarded and as a result comparatively large amounts of martensite remain in the microstructure. The Mn content of a steel according to the invention is set at 1.7-2.5% wt.

In a steel according to the invention, Al is present in contents of 0.5-1.5% wt. and Si is present in contents of 0.2-0.7% wt., in order to prevent carbide formation in the bainite range during the overageing treatment carried out in the course of processing the steel according to the invention. The bainite transformation does not fully take place as a result of the presence of Al and Si, so that only bainitic ferrite is formed and the carbide formation does not come about. In this way, the stability of residual austenite enriched with carbon aimed for according to the invention is obtained. This effect can be particularly reliably ensured by limiting the Si content to up to 0.6% wt. or the Al content to 0.7-1.4% wt., wherein Si contents of more than 0.2% wt. and less than 0.6% wt. are set and the Al contents are between 0.7% wt., and 1.4% wt. With the combined presence of Si and Al, optimum properties for the multi-phase steel according to the invention result when the sum of its Al and Si contents is 1.2-2.0% wt.

Cr and Mo are not wanted in a steel according to the invention and are, therefore, only to be present in ineffective amounts, since they retard the bainitic transformation and hinder the stabilising of the residual austenite. Therefore, according to the invention, the Cr content is limited to less than 0.1% wt. and the Mo content of a steel according to the invention to less than 0.05% wt., in particular to less than 0.01% wt.

A steel according to the invention contains Nb in contents of 0.02-0.06% wt. and optionally one or more of the elements "Ti, V, B", in order to increase the strength of the steel according to the invention. Nb, Ti, V and B form very fine precipitations with the C and N present in the steel according to the invention. These precipitations have a strength-increasing and yield-point-increasing effect through particle hardening and grain refinement. The grain refinement is also very advantageous for the forming properties of the steel.

Ti removes N by chemical combination even during solidification or at very high temperatures, so that possible negative effects of this element on the properties of the steel according to the invention are reduced to a minimum. In order to make use of these effects, in addition to the ever-present Nb up to 0.1% wt. Ti and up to 0.15% wt. V can be added to a steel according to the invention. Exceeding the upper limits predetermined according to the invention of the contents of micro-alloying elements would result in retarding the recrystallisation during annealing, so that during real production this would either not be able to be achieved or would require an additional furnace output.

The positive effect of the presence of Ti in relation to the removal of the N content by chemical combination can be particularly used in a targeted way if the Ti content "% Ti" of a multi-phase steel according to the invention fulfils the following condition [3]:

$$\% \text{ Ti} \geq 3.4 \times \% \text{ N}, \quad [3]$$

wherein "% N" denotes the respective N content of the multi-phase steel and this condition must in particular then be met when the Ti content is 0.01-0.03% wt.

The positive effect of Ti in a steel according to the invention occurs in a particularly reliable manner if its Ti content is at least 0.01% wt.

By adding up to 0.002% wt. boron, ferrite formation can be retarded during cooling, so that a larger amount of austenite is present in the bainite range. The amount and the stability of the residual austenite can thereby be increased. Furthermore, instead of normal ferrite, bainitic ferrite is formed which contributes to increasing the yield point.

Practice-oriented variants of the steel according to the invention, which are particularly favourable with regard to the costs and the profile of properties of the steel according to the invention, result if the Ti content is limited to 0.02% wt. and B is present in contents of 0.0005-0.002% wt. or V is present in contents of 0.06-0.15% wt.

In the microstructure of a steel according to the invention, at least 10% vol. ferrite, in particular at least 12% vol. ferrite, and at least 6% vol. residual austenite are present, in order on the one hand to ensure the sought after high strength and on the other hand to ensure good deformability of the steel. For this purpose, dependent on the amount of the remaining microstructure constituents, up to 90% vol. of the microstructure can consist of ferrite and up to a maximum of 20% vol. residual austenite. Contents of at least 5% vol. martensite in the microstructure of the steel according to the invention contribute to its strength, wherein the martensite content should be limited to a maximum of 40% vol., in order to guarantee a sufficient ductility of the steel according to the invention. Optionally, 5-40% vol. bainite can be present in the microstructure of a steel according to the invention.

Preferably, the residual austenite of a steel according to the invention is enriched with carbon in such away that its $C_{inRA}$ content calculated according to the formula [1] published in the article by A. Zarel Hanzaki et al. in ISIJ Int. Vol. 35, No. 3, 1995, pp. 324-331 is more than 0.6% wt.

$$C_{inRA}=(a_{RA}-a_{\gamma})/0.0044 \quad [1]$$

with $a_{\gamma}$: 0.3578 nm (the lattice constant of the austenite);

$a_{RA}$: the respective lattice parameter of the residual austenite in nm, measured on the finished cold strip after the final cooling.

The amount of carbon present in the residual austenite has a significant effect on the TRIP properties and the ductility of a steel according to the invention.

Accordingly, it is advantageous if the $C_{inRA}$ content is as high as possible.

With regard to the high stability of the residual austenite aimed for, it is furthermore advantageous if it has a grade $G_{RA}$ of residual austenite ("residual austenite grade") calculated according to formula [2] of more than 6, in particular more than 8.

$$G_{RA}=\% \text{ RA} \times C_{inRA} \quad [2]$$

with % RA: the residual austenite content of the multi-phase steel in % vol.;

$C_{inRA}$: the C content of the residual austenite calculated according to formula [1].

A cold-rolled flat product of the kind according to the invention can be produced in the way according to the invention by melting a multi-phase steel according to the invention and casting it into a semi-finished product in the first production step. This semi-finished product can be a slab or thin slab.

The semi-finished product is then, as required, reheated to a temperature of 1100-1300° C. starting from which the semi-finished product is then hot rolled into a hot strip. The final temperature of the hot rolling is 820-950° C. according to the invention. The hot strip obtained is wound into a coil at a coiling temperature of 400-750° C., in particular at a coiling temperature of 530-600° C.

The hot strip can be subjected to annealing after the coiling and before the cold rolling, in order to improve the cold rollability of the hot strip. This can advantageously be carried out as batch annealing or annealing completed in a continuous run. The annealing temperatures set during the annealing which prepares the cold rolling are typically 400-700° C.

After coiling, the hot strip is cold rolled into a cold flat product at cold rolling degrees of 30-80%, in particular 50-70%, wherein cold rolling degrees of 30-75%, in particular 50-65%, particularly reliably produce the desired result. The cold flat product obtained is subsequently subjected to a heat treatment, in which it firstly passes through a continuous annealing operation at an annealing temperature of 750-900° C., in particular 800-830° C., in order then to be subjected to an overageing treatment at an overageing temperature of 350-500° C., in particular 370-460° C. The annealing time, over which the cold flat product is annealed at the annealing temperature in the course of continuous annealing, is typically 10-300 s, while the overageing treatment time carried out after the annealing can be up to 800 s, wherein here the minimum annealing time will usually be 10 s.

Optionally, the annealed cold flat product can be rapidly cooled between the annealing and the overageing treatments, in order to obtain a retransformation into ferrite and suppress the formation of perlite. For this purpose, starting from the annealing temperature to an intermediate temperature of 500° C., the cooling rate respectively set can be at least 5° C./s. Subsequently, where required, the cold flat product is held at the intermediate temperature over a period of time which is sufficient for the desired microstructure to form, following which the cold flat product is then further cooled.

The cold flat product can be annealed in the course of a hot-dip coating operation, in which the cold flat product is provided with a metallic protective coating.

It is also possible to provide the cold strip produced according to the invention with a protective coating after the heat treatment by means of electrolytic coating or another deposition process.

Additionally or alternatively, it can also be advantageous to coat the cold flat product with an organic protective coating.

Optionally, the cold strip obtained can also be subjected to another subsequent rolling operation at degrees of deformation of up to 10%, in order to improve its dimensional stability, surface condition and mechanical properties.

As proof of the properties of sheets constituted and produced according to the invention, the melts S1 to S13 specified in Table 1 were melted and processed into cold flat products K1-K41.

The production of the cold flat products K1-K41 comprised the following production steps:

melting and casting the melts S1-S13 each into a respective thin slab;

hot rolling the thin slab of the semi-finished product into a hot strip starting from an initial temperature WAT and ending at a final temperature WET;

coiling the hot strip at a coiling temperature HT;

cold rolling the hot strip after coiling into the respective cold flat product K1-K41 at cold rolling degrees KWG;

continuously annealing the cold flat product at an annealing temperature GT within an annealing time Gt;

overageing the cold flat product at an overageing temperature of UA T over an overageing time UA t.

In Table 2, the respectively set parameters "annealing temperature GT", "annealing time Gt", "cooling rate V after annealing", "overageing temperature UA T" and "overageing time UA t" are specified for annealing and overageing cycles 1-15.

The other respectively set parameters during the production of the cold flat products K1-K41 which are present here as cold strips or cold sheets, the annealing cycle chosen in each case and the properties of the cold strips K1-K14 obtained are recorded in Table 3.

TABLE 1

(content data in % wt., remainder iron and unavoidable impurities)

| Melt | C | Si | Mn | Al | Nb | V | Ti | P | S | N | B | Acc. to invention? |
|---|---|---|---|---|---|---|---|---|---|---|---|---|
| S1 | 0.210 | 0.41 | 1.82 | 1.020 | 0.041 | 0.004 | 0.005 | 0.004 | 0.003 | 0.0015 | 0.0005 | YES |
| S2 | 0.250 | 0.42 | 1.79 | 0.970 | 0.044 | 0.006 | 0.003 | 0.005 | 0.004 | 0.0041 | 0.0004 | YES |
| S3 | 0.230 | 0.42 | 2.48 | 0.980 | 0.042 | 0.005 | 0.015 | 0.006 | 0.005 | 0.0016 | 0.0004 | YES |
| S4 | 0.220 | 0.42 | 2.27 | 0.98 | 0.040 | 0.011 | 0.015 | 0.004 | 0.003 | 0.0016 | 0.0016 | YES |
| S5 | 0.231 | 0.70 | 1.83 | 1.020 | 0.044 | 0.120 | 0.006 | 0.004 | 0.003 | 0.0015 | 0.0005 | YES |
| S6 | 0.220 | 0.40 | 1.83 | 1.03 | 0.045 | 0.006 | 0.003 | 0.004 | 0.005 | 0.0011 | 0.0006 | YES |
| S7 | 0.231 | 0.40 | 1.90 | 1.400 | 0.025 | 0.100 | 0.007 | 0.004 | 0.004 | 0.0013 | 0.0004 | YES |
| S8 | 0.215 | 0.41 | 2.23 | 0.970 | 0.058 | 0.005 | 0.004 | 0.003 | 0.004 | 0.0014 | 0.0005 | YES |
| S9 | 0.222 | 0.40 | 1.80 | 1.01 | 0.045 | 0.10 | 0.003 | 0.004 | 0.004 | 0.0017 | 0.0005 | YES |
| S10 | 0.220 | 0.65 | 1.95 | 1.250 | 0.029 | 0.006 | 0.019 | 0.005 | 0.003 | 0.0016 | 0.0013 | YES |
| S11 | 0.215 | 0.41 | 2.24 | 0.91 | 0.041 | 0.11 | 0.004 | 0.005 | 0.003 | 0.0016 | 0.0005 | YES |
| S12 | 0.220 | 0.35 | 2.50 | 1.230 | 0.027 | 0.005 | 0.017 | 0.005 | 0.003 | 0.0016 | 0.0010 | YES |
| S13 | 0.226 | 0.41 | 1.81 | 1.03 | 0.003 | 0.005 | 0.001 | 0.003 | 0.005 | 0.0013 | 0.0006 | NO |

TABLE 2

| Annealing cycle no. | GT [° C.] | Gt [s] | V [° C./s] | UA T [° C.] | UA t [s] |
|---|---|---|---|---|---|
| 1 | 820 | 60 | 15 | 375 | 60 |
| 2 | 820 | 60 | 15 | 375 | 120 |
| 3 | 820 | 60 | 15 | 375 | 360 |
| 4 | 820 | 60 | 15 | 425 | 30 |
| 5 | 820 | 60 | 15 | 425 | 60 |
| 6 | 820 | 60 | 15 | 425 | 120 |
| 7 | 820 | 60 | 15 | 450 | 30 |
| 8 | 820 | 60 | 15 | 450 | 60 |
| 9 | 820 | 60 | 15 | 450 | 120 |
| 10 | 820 | 60 | 50 | 425 | 30 |
| 11 | 820 | 60 | 50 | 425 | 60 |
| 12 | 820 | 60 | 50 | 425 | 120 |
| 13 | 820 | 60 | 100 | 425 | 120 |
| 14 | 840 | 60 | 100 | 425 | 120 |
| 15 | 860 | 60 | 100 | 425 | 120 |

TABLE 3

| | Melt | Anneal. Nr. | WAT [° C.] | WET [° C.] | HT [° C.] | KWG [%] | $R_{eL}$ [MPa] | $R_m$ [MPa] | $A_{80}$ [%] | RA [% vol.] | $C_{inRA}$ [% wt.] | Grade RA | $a_{Ra}$ [nm] | Acc. to inv.? |
|---|---|---|---|---|---|---|---|---|---|---|---|---|---|---|
| K1 | S1 | 1 | 1250 | 940 | 600 | 65 | 512 | 975 | 23.1 | 18.0 | 0.76 | 13.68 | 0.3611 | YES |
| K2 | S1 | 2 | 1260 | 940 | 610 | 68 | 550 | 1002 | 23.7 | 17.0 | 0.78 | 13.26 | 0.3612 | YES |
| K3 | S1 | 3 | 1250 | 930 | 620 | 63 | 561 | 963 | 24.6 | 16.5 | 0.81 | 13.37 | 0.3614 | YES |
| K4 | S2 | 13 | 1300 | 930 | 700 | 63 | 614 | 1070 | 18.2 | 15.0 | 0.91 | 13.65 | 0.3618 | YES |
| K5 | S2 | 14 | 1140 | 950 | 690 | 55 | 603 | 1050 | 23.1 | 15.5 | 0.93 | 14.42 | 0.3619 | YES |
| K6 | S2 | 15 | 1250 | 870 | 400 | 56 | 580 | 1020 | 23.6 | 17.0 | 0.94 | 15.98 | 0.3619 | YES |
| K7 | S3 | 10 | 1160 | 860 | 430 | 52 | 552 | 1103 | 15.5 | 15.0 | 0.65 | 9.75 | 0.3607 | YES |
| K8 | S3 | 11 | 1180 | 870 | 420 | 55 | 584 | 1070 | 17.1 | 17.5 | 0.74 | 12.95 | 0.3611 | YES |
| K9 | S3 | 12 | 1180 | 920 | 560 | 54 | 570 | 1007 | 18.2 | 18.0 | 0.78 | 14.04 | 0.3612 | YES |
| K10 | S4 | 10 | 1190 | 920 | 560 | 63 | 509 | 964 | 16.1 | 15.5 | 0.73 | 11.32 | 0.3610 | YES |
| K11 | S4 | 11 | 1170 | 910 | 550 | 75 | 592 | 990 | 18.5 | 18.0 | 0.82 | 14.76 | 0.3614 | YES |
| K12 | S4 | 12 | 1260 | 910 | 530 | 73 | 548 | 1050 | 21.4 | 19.0 | 0.80 | 15.20 | 0.3613 | YES |
| K13 | S4 | 14 | 1240 | 820 | 450 | 30 | 517 | 1035 | 25.6 | 13.0 | 0.95 | 12.35 | 0.3620 | YES |
| K14 | S5 | 7 | 1300 | 940 | 560 | 54 | 503 | 981 | 18.1 | 16.5 | 0.78 | 12.87 | 0.3612 | YES |
| K15 | S5 | 8 | 1250 | 830 | 450 | 45 | 524 | 968 | 19.3 | 17.5 | 0.83 | 14.53 | 0.3615 | YES |
| K16 | S5 | 9 | 1140 | 850 | 460 | 50 | 563 | 1003 | 20.8 | 18.0 | 0.85 | 15.30 | 0.3615 | YES |
| K17 | S6 | 4 | 1150 | 900 | 500 | 50 | 532 | 1010 | 25.9 | 18.0 | 0.84 | 15.12 | 0.3615 | YES |
| K18 | S6 | 5 | 1300 | 900 | 530 | 56 | 575 | 986 | 26.6 | 16.5 | 0.91 | 15.02 | 0.3618 | YES |
| K19 | S6 | 6 | 1290 | 930 | 530 | 53 | 584 | 978 | 28.0 | 16.5 | 0.95 | 15.68 | 0.3620 | YES |
| K20 | S7 | 4 | 1280 | 920 | 540 | 54 | 520 | 965 | 22.1 | 17.5 | 0.76 | 13.30 | 0.3611 | YES |
| K21 | S7 | 5 | 1280 | 930 | 700 | 56 | 536 | 954 | 22.5 | 18.0 | 0.81 | 14.58 | 0.3614 | YES |
| K22 | S7 | 6 | 1290 | 910 | 650 | 58 | 587 | 992 | 21.4 | 18.5 | 0.84 | 15.54 | 0.3615 | YES |
| K23 | S8 | 13 | 1150 | 880 | 430 | 60 | 571 | 997 | 20.7 | 14.5 | 0.91 | 13.20 | 0.3618 | YES |
| K24 | S8 | 14 | 1150 | 870 | 460 | 65 | 525 | 981 | 22.4 | 15.0 | 0.95 | 14.25 | 0.3620 | YES |
| K25 | S8 | 15 | 1100 | 880 | 460 | 45 | 521 | 962 | 24.1 | 15.5 | 0.94 | 14.57 | 0.3619 | YES |
| K26 | S9 | 4 | 1160 | 930 | 660 | 63 | 511 | 1009 | 18.7 | 17.0 | 0.77 | 13.09 | 0.3612 | YES |
| K27 | S9 | 5 | 1230 | 950 | 650 | 62 | 526 | 1021 | 19.5 | 17.5 | 0.82 | 14.35 | 0.3614 | YES |
| K28 | S9 | 6 | 1230 | 950 | 650 | 70 | 574 | 1019 | 21.2 | 18.5 | 0.86 | 15.91 | 0.3616 | YES |
| K29 | S10 | 10 | 1170 | 940 | 680 | 75 | 510 | 1003 | 20.1 | 17.5 | 0.79 | 13.83 | 0.3613 | YES |
| K30 | S10 | 11 | 1240 | 930 | 560 | 64 | 564 | 997 | 21.6 | 18.5 | 0.84 | 15.54 | 0.3615 | YES |
| K31 | S10 | 12 | 1200 | 850 | 490 | 55 | 589 | 1011 | 22.2 | 18.5 | 0.88 | 16.28 | 0.3617 | YES |
| K32 | S11 | 10 | 1190 | 860 | 470 | 46 | 545 | 1130 | 15.5 | 15.0 | 0.70 | 10.50 | 0.3609 | YES |
| K33 | S11 | 11 | 1190 | 870 | 470 | 35 | 529 | 1062 | 16.7 | 17.0 | 0.82 | 13.94 | 0.3614 | YES |
| K34 | S11 | 12 | 1150 | 910 | 530 | 49 | 602 | 1018 | 18.1 | 18.0 | 0.80 | 14.40 | 0.3613 | YES |
| K35 | S11 | 14 | 1160 | 920 | 520 | 51 | 608 | 993 | 23.4 | 13.5 | 0.93 | 12.56 | 0.3619 | YES |
| K36 | S12 | 10 | 1140 | 910 | 520 | 52 | 542 | 1089 | 15.9 | 15.5 | 0.65 | 10.08 | 0.3607 | YES |
| K37 | S12 | 11 | 1200 | 920 | 530 | 50 | 583 | 1054 | 18.1 | 17.0 | 0.63 | 10.71 | 0.3606 | YES |
| K38 | S12 | 12 | 1210 | 930 | 560 | 49 | 589 | 1023 | 19.4 | 18.5 | 0.67 | 12.40 | 0.3607 | YES |
| K39 | S13 | 7 | 1210 | 940 | 700 | 70 | 404 | 796 | 30.0 | 19.5 | 0.91 | 17.75 | 0.3618 | NO |
| K40 | S13 | 8 | 1220 | 860 | 410 | 45 | 440 | 763 | 27.0 | 18.0 | 0.93 | 16.74 | 0.3619 | NO |
| K41 | S13 | 9 | 1230 | 870 | 420 | 60 | 453 | 775 | 25.4 | 17.5 | 0.95 | 16.63 | 0.3620 | NO |

The invention claimed is:

1. A multi-phase steel consisting of, in % wt.,

C: 0.14-0.25%

Mn: 1.7-2.5%

Si: 0.2-0.7%

Al: 0.5-1.5%

Cr: <0.1%

Mo: <0.05%

Nb: 0.02-0.06%

S: up to 0.01%

P: up to 0.02%

N: up to 0.01% and optionally at least one element from the group Ti, B, and V according to the following stipulation:

Ti: up to 0.1%

B: up to 0.002%

V: up to 0.15% with the remainder iron and unavoidable impurities, wherein, in the microstructure of the steel, at least 10% vol. ferrite, 6 to 20% vol. residual austenite, 5 to 40% vol. martensite, and, optionally, 5 to 40% vol. bainite are present and the steel has a tensile strength, $R_m$, of at least 950 MPa, a yield point, $R_{eL}$, of at least 500 MPa and an elongation at break, $A_{80}$, measured in the transverse direction of at least 15%.

2. The multi-phase steel according to claim 1, wherein the carbon content of the residual austenite, $C_{inRA}$, calculated according to formula [1] is more than 0.6% wt.:

$$C_{inRA}=(a_{RA}-a_{\gamma})/0.0044 \quad [1]$$

with $a_{\gamma}$: 0.3578 nm, a lattice constant of the austenite;

$a_{RA}$: a lattice parameter of the residual austenite in the finished multi-phase steel after final cooling in nm.

3. The multi-phase steel according to claim 1, wherein the sum of the Al and Si contents is 1.2-2.0% wt.

4. The multi-phase steel according to claim 1, wherein the Si content is less than 0.6% wt.

5. The multi-phase steel according to claim 1, wherein the Al content is 0.7-1.4% wt.

6. The multi-phase steel according to claim 1, wherein the Ti content is up to 0.02% wt.

7. The multi-phase steel according to claim 1, wherein the Ti content % Ti fulfils the condition [3]:

$$\%\ Ti \geq 3.4 \times \%\ N \quad [3]$$

with % N: the N content of the multi-phase steel.

8. The multi-phase steel according to claim 1, wherein the B content is at least 0.0005% wt.

9. The multi-phase steel according to claim 1, wherein the V content is at least 0.06% wt.

10. A cold flat product produced from the multi-phase steel of claim 1.

11. A multi-phase steel according to claim 2, wherein the multi-phase steel has a grade, $G_{RA}$, of the residual austenite calculated according to formula [2], for which $G_{RA}>6$ applies:

$$G_{RA}=\%\ RA\times C_{inRA} \quad [2]$$

with % RA: the residual austenite content of the multi-phase steel in % vol.;

$C_{inRA}$: the carbon content of the residual austenite calculated according to formula [1].

12. A method for producing a cold flat product, comprising:

melting and casting the multi-phase steel of claim 1 into a semi-finished product;

hot rolling the semi-finished product into a hot strip starting from an initial temperature of 1100-1300° C. and ending at a final temperature of 820-950° C.;

coiling the hot strip at a coiling temperature of 400-750° C.;

optionally annealing the hot strip to improve its ability to be cold rolled;

after coiling, cold rolling the hot strip into the cold flat product at cold rolling degrees of 30-80%;

continuously annealing the cold flat product at an annealing temperature of 750-900° C.;

optionally accelerated cooling at a cooling rate of at least 5° C./s of the continuously annealed cold flat product; and overageing the cold flat product at an overageing temperature of 350-500° C.

13. The method according to claim 12, characterised in that the coiling temperature is 530-600° C., the cold-rolling degree is 50-70%, the annealing temperature is 800-830° C. or the overageing temperature is 370-460° C.

14. The method according to claim 12, wherein the annealing optionally performed after the coiling and before the cold rolling is carried out as batch annealing or as continuous annealing at an annealing temperature of 400-700° C.

* * * * *